United States Patent [19]

Morichika et al.

[11] 4,421,558

[45] Dec. 20, 1983

[54] IRON-BASED HEAT-RESISTANT CAST ALLOY

[75] Inventors: Toshiaki Morichika; Junichi Sugitani, both of Hirakata; Takao Kobayashi, Nara, all of Japan

[73] Assignee: Kubota Ltd., Osaka, Japan

[21] Appl. No.: 222,629

[22] Filed: Jan. 5, 1981

[30] Foreign Application Priority Data

Jan. 10, 1980 [JP] Japan ..... 55-1684

[51] Int. Cl.[3] ..... C22C 38/48

[52] U.S. Cl. ..... 75/128 E; 75/128 G; 420/584

[58] Field of Search ..... 75/122, 134 F, 128 E, 75/128 F, 128 N, 128 G, 128 Z, 128 T, 128 W

[56] References Cited

U.S. PATENT DOCUMENTS 3,627,516 12/1971 Bellot et al. ..... 75/128 G
3,833,358 9/1974 Bellot et al. ..... 75/122
3,865,581 2/1975 Sekino et al. ..... 75/122

FOREIGN PATENT DOCUMENTS 55-41291 10/1980 Japan .

*Primary Examiner*—R. Dean

*Attorney, Agent, or Firm*—Oblon, Fisher, Spivak, McClelland & Maier

[57] ABSTRACT

An iron-based heat-resistant cast alloy for high-temperature, high-pressure pipe, consisting essentially of, by weight %,

| | |
|---|---|
| C | 0.10 to 0.16 |
| $1.0 \geqq Si > 0$ | |
| $1.5 \geqq Mn > 0$ | |
| Cr | 17 to 23 |
| Ni | 28 to 35 |
| Nb | 0.3 to 2.0 |
| $0.1 \geqq Mo \geqq 0$ | |
| $0.08 \geqq N \geqq 0$ | |

One or two or more kinds of:

| | |
|---|---|
| B | 0.001 to 0.080 |
| Ti | 0.011 to 0.02 |
| Ca | 0.001 to 0.01 |
| Ce and/or La | 0.001 to 0.01 |
| Zr | 0.01 to 0.10 |
| Fe | balance. |

4 Claims, No Drawings

IRON-BASED HEAT-RESISTANT CAST ALLOY

BACKGROUND OF THE INVENTION

The present invention relates to an iron-based heat-resistant cast alloy. It relates more particularly to an iron-based heat-resistant cast alloy possessing enough high-temperature creep rupture strength and creep rupture ductility necessary for high-temperature, high-pressure piping material, and also having a sufficient weldability to be used as welded structure.

Prior to the present invention, various cast alloys such as HK40 (25Cr-20Ni steel) (see ASTM A608() and HU (19Cr-39Ni steel) (see ASTM A297) and forged alloys such as Incoloy 800 (see ASTM B407) have been used as the materials for manifolds and collectors of furnaces for producing hydrogen, methanol and ammonia, naphtha modifying furnace and other heat treating furnaces.

However, since, for example, the manifold of naphtha modifying furnace is exposed to high temperatures of 700° to 900° C. and high pressures of 10 to 30 atm., and yet to irregular cycles of thermal expansion and shrinkage, the conventional cast alloys and forged alloys were inadequate as the materials for the manifold.

This is because the cast alloys, such as said HK40 and Hu, produces, when heated to a high temperature, fine secondary carbides in their metal structure, which are hardened to deteriorate the toughness. On the other hand, in the case of Incoloy 800 forged alloy, since the creep rupture strength is low, a larger thickness is needed, as compared with cast alloy, under the identical operating conditions, which naturally results in a heavier weight. That is, since the wall thickness is larger, the temperature difference between the inside and outside of the wall becomes larger, which subsidiarily lead to thermal stress.

Accordingly, seeing that the manifold of naphtha modifying furnace is part of high-temperature, high-pressure piping line, and that the manifold itself is complicated in shape and is sure to be welded in the fabrication process thereof, the material for this manifold requires high creep rupture strength, excellent ductility, and good weldability. All these three conditions are not, in reality, satisfied in the conventional cast alloys and forged alloys.

SUMMARY OF THE INVENTION

This invention has solved various problems experienced in the conventional cast alloys and forged alloys, and is intended to disclose an iron-based heat-resistant cast alloy possessing high creep rupture strength, high toughness and excellent weldability as high-temperature, high-pressure piping material.

The principal feature of the iron-based heat-resistant cast alloy relating to the present invention lies in the composition thereof, containing C 0.10 to 0.16%, Si 1.0% or less, Mn 1.5% or less, Cr 17 to 23%, Ni 28 to 35%, Nb 0.3 to 2.0%, Mo 0.1% or less, and N 0.08% or less, and one or two or more kinds of B 0.001 to 0.080%, Ti 0.001 to 0.02%, Ca 0.001 to 0.010%, Ce and/or La 0.001 to 0.01% and Zr 0.01 to 0.10%, and the substantial balance of Fe.

DETAILED DESCRIPTION OF THE INVENTION

The iron-based heat-resistant cast alloy by the present invention possesses the following components:

| (contents by wt. %) | |
|---|---|
| C | 0.10 to 0.16 |
| $1.0 \geqq Si > 0$ | |
| $1.5 \geqq Mn > 0$ | |
| Cr | 17 to 23 |
| Ni | 28 to 35 |
| Nb | 0.3 to 2.0 |
| $0.1 \geqq Mo \geqq 0$ | |
| $0.08 \geqq N \geqq 0$ | |

One or two or more kinds of:

| | |
|---|---|
| B | 0.001 to 0.080 |
| Ti | 0.001 to 0.02 |
| Ca | 0.001 to 0.010 |
| Ce and/or La | 0.001 to 0.01 |
| Zr | 0.01 to 0.10 |
| Fe | balance |

wherein, the lower limits of Si and Mn may be an ordinary amount mixed in deoxidizer used when melting an alloy, but should not be zero.

In the first place, below are described the components and the percentage thereof contained in the iron-based heat-resistant cast alloy relating to the present invention.

C is an element to impart toughness. When the content is less than 0.10%, the creep rupture strength is low; when exceeding 0.16%, the creep rupture strength is sufficient, but the toughness deterioration after heating to high temperature becomes becomes extreme. Hence, the C content should be within the range of 0.10 to 0.16%.

Si is present as deoxidizer. Since its content of larger than 1.0% deteriorates the weldability, the Si content should be 1.0% or less.

Mn is, together with Si, present in very small amounts as a as deoxidizer. When it is present in amounts more than 1.5%, weldability deteriorates and strength drops; hence the content of Mn should be 1.5% or less.

Cr, when it is present together with Ni mentioned below, contributes to enhancement of heat resistance and oxidation resistance as austenite structure. When the content is less than 17%, the oxidation resistance is not sufficient as high-temperature material; when exceeding 23%, it lowers the creep rupture elongation as toughness at high temperature, in relation to Ni content. Hence, the content of Cr should be within the range of 17 to 23%.

Ni, when it is contained together with said Cr, keeps the austenite structure stable, and contributes to enhancement of heat resistance and oxidation resistance. When the content is less than 28%, the austenite structure becomes unstable; if it is present in amounts of 35% or more, the effect is not obviously changed, hence it is not economical. Accordingly, Ni should be contained in the range of 28 to 35%.

Nb is an element to improve the creep rupture strength. When the content is less than 0.3%, the creep rupture strength drops; when exceeding 2.0%, it not only leads to notable drop of creep rupture strength, but also invites lowering of weldability. Hence, the content of Nb should be 0.3 to 2.0%.

Mo, when contained together with N, adversely affects the weldability, and it should be contained as little as possible, preferably by 0.1% or less. Therefore, the raw materials should be strictly controlled so that Mo may not be contained by more than 0.1%.

N, when contained together with said Mo, adversely affects the weldability, and it should be contained as little as possible, preferably by 0.08% or less. Therefore, the manufacturing process should be strictly controlled so that N may not be mixed in from the raw materials and from the atmosphere during melting.

Yet, when Mo and N are contained simultaneously as impurities (compound mixture) in the coexistence with said Nb, they effect an extremely adverse effect on the weldability unless their contents are strictly checked. Their contents should be, therefore, controlled more strictly.

B is an element to improve the creep rupture strength. When the content is less than 0.001%, it does not present any effect to improve the creep rupture strength; when contained more than 0.080%, it deteriorates the weldability. Hence, the B content should be within 0.001 to 0.080%.

Ti is an element to improve the weldability. When the content is less than 0.001%, it does not present any effect to improve the weldability; when contained more than 0.02%, it deteriorates the weldability. Hence, the Ti content should be within 0.001 to 0.02%.

Ca, like Ti, contributes to improvement of weldability. When the content is less than 0.001%, it does not improve the weldability; when contained more than 0.010%, it deteriorates the weldability. Hence, the Ca content should be within 0.001 to 0.010%.

Ce and La are rare earth elements, and have equal effect in the improvement of weldability. When the content is less than 0.001%, there is no effect; when contained more than 0.01%, the weldability is deteriorated. Hence, the content of Ce or La, or the total content of Ce+La should be within 0.001 to 0.01%.

Zr is also an element to improve the weldability. When the content is less than 0.01%, it has no effect to improve the weldability; when contained more than 0.10%, it not only deteriorates the weldability, but also invites reduction of creep rupture strength. Hence, the content of Zr should be within 0.01 to 0.10%.

Followings are embodiments of iron-based heat-resistant alloys relating to the present invention.

Embodiments:

TABLE 1

| | Division | C | Si | Mn | Cr | Ni | Nb | Mo | N | B | Ti | Ce and/or La | Ca | Zr | P or S |
|---|---|---|---|---|---|---|---|---|---|---|---|---|---|---|---|
| 1 | This invention | 0.11 | 0.67 | 1.05 | 20.5 | 33.5 | 0.36 | 0.01 | 0.05 | 0.005 | <0.001 | <0.001 | <0.001 | <0.01 | <0.03 |
| 2 | " | 0.12 | 0.69 | 1.16 | 20.3 | 33.0 | 0.96 | 0.02 | 0.04 | 0.075 | 0.010 | <0.001 | <0.001 | <0.01 | <0.03 |
| 3 | " | 0.11 | 0.70 | 1.05 | 20.6 | 33.1 | 1.17 | 0.01 | 0.06 | 0.011 | 0.006 | <0.001 | <0.001 | <0.01 | <0.03 |
| 4 | " | 0.11 | 0.65 | 1.10 | 20.4 | 33.5 | 1.46 | 0.01 | 0.05 | 0.023 | <0.001 | <0.001 | <0.001 | <0.01 | <0.03 |
| 5 | " | 0.12 | 0.71 | 1.12 | 20.0 | 33.4 | 1.80 | 0.01 | 0.05 | 0.038 | <0.001 | <0.001 | <0.001 | <0.01 | <0.03 |
| 6 | " | 0.12 | 0.71 | 1.14 | 20.3 | 33.0 | 1.19 | 0.01 | 0.05 | <0.001 | 0.004 | <0.001 | <0.001 | <0.01 | <0.03 |
| 7 | " | 0.12 | 0.65 | 1.15 | 20.4 | 33.5 | 1.14 | 0.01 | 0.05 | <0.001 | 0.020 | <0.001 | <0.001 | <0.01 | <0.03 |
| 8 | " | 0.12 | 0.66 | 1.14 | 20.3 | 32.9 | 1.10 | 0.01 | 0.05 | <0.001 | <0.001 | 0.003 | <0.001 | <0.01 | <0.03 |
| 9 | " | 0.12 | 0.69 | 1.14 | 20.4 | 33.1 | 1.15 | 0.01 | 0.05 | <0.001 | <0.001 | 0.009 | <0.001 | <0.01 | <0.03 |
| 10 | " | 0.11 | 0.69 | 1.10 | 20.3 | 33.1 | 1.11 | 0.01 | 0.04 | <0.001 | <0.001 | <0.001 | 0.003 | <0.01 | <0.03 |
| 11 | " | 0.11 | 0.73 | 1.05 | 20.3 | 33.0 | 1.17 | 0.01 | 0.05 | <0.001 | <0.001 | <0.001 | 0.009 | <0.01 | <0.03 |
| 12 | " | 0.12 | 0.70 | 1.12 | 20.5 | 33.3 | 1.55 | 0.01 | 0.05 | <0.001 | <0.001 | <0.001 | <0.001 | 0.02 | <0.03 |
| 13 | " | 0.12 | 0.70 | 1.09 | 20.1 | 33.0 | 1.60 | 0.02 | 0.06 | <0.001 | <0.001 | <0.001 | <0.001 | 0.09 | <0.03 |
| 14 | " | 0.11 | 0.69 | 1.09 | 20.0 | 32.7 | 1.06 | 0.02 | 0.05 | 0.051 | 0.004 | 0.003 | 0.004 | 0.04 | <0.03 |
| 15 | " | 0.11 | 0.73 | 1.15 | 20.3 | 33.4 | 1.10 | 0.01 | 0.04 | 0.043 | 0.013 | <0.001 | <0.001 | <0.01 | <0.03 |
| 16 | " | 0.12 | 0.71 | 1.15 | 20.3 | 33.5 | 1.08 | 0.01 | 0.05 | 0.016 | 0.009 | 0.005 | <0.001 | <0.01 | <0.03 |
| 17 | " | 0.11 | 0.70 | 1.15 | 20.4 | 33.1 | 1.20 | 0.01 | 0.05 | 0.040 | 0.008 | 0.003 | 0.003 | <0.01 | <0.03 |
| 18 | Reference | 0.11 | 0.71 | 1.08 | 20.0 | 33.5 | 1.11 | 0.02 | 0.05 | 0.090 | <0.001 | <0.001 | <0.001 | <0.01 | <0.03 |
| 19 | " | 0.12 | 0.69 | 1.10 | 20.4 | 33.0 | 1.13 | 0.02 | 0.05 | <0.001 | 0.056 | <0.001 | <0.001 | <0.01 | <0.03 |
| 20 | " | 0.12 | 0.73 | 1.15 | 20.7 | 32.9 | 1.21 | 0.02 | 0.06 | <0.001 | <0.001 | 0.015 | <0.001 | <0.01 | <0.03 |
| 21 | " | 0.11 | 0.68 | 1.07 | 20.3 | 33.5 | 1.15 | 0.01 | 0.06 | <0.001 | <0.001 | <0.001 | 0.016 | <0.01 | <0.03 |
| 22 | " | 0.11 | 0.68 | 1.09 | 20.1 | 33.5 | 1.14 | 0.01 | 0.05 | <0.001 | <0.001 | <0.001 | <0.001 | 0.18 | <0.03 |
| 23 | " | 0.12 | 0.66 | 1.13 | 20.1 | 33.1 | 1.55 | 0.13 | 0.10 | <0.001 | <0.001 | <0.001 | <0.001 | <0.01 | <0.03 |
| 24 | " | 0.12 | 0.65 | 1.15 | 20.3 | 33.3 | 0.55 | 0.15 | 0.11 | <0.001 | <0.001 | <0.001 | <0.001 | <0.01 | <0.03 |
| 25 | " | 0.10 | 0.65 | 1.17 | 20.3 | 32.8 | 1.15 | 0.02 | 0.05 | <0.001 | <0.001 | <0.001 | <0.001 | <0.01 | <0.03 |

TABLE 2

| No. | Division | Creep rupture test Temperature | Creep rupture test Stress (kg/mm$^2$) | Rupture time (hr) | Rupture elongation (%) |
|---|---|---|---|---|---|
| 1 | This invention | 900 | 3.5 | 1,013 | 16.6 |
| 2 | This invention | " | " | 1,638 | 21.1 |
| 3 | This invention | " | " | 1,471 | 24.1 |
| 4 | This invention | " | " | 1,451 | 26.8 |
| 5 | This invention | " | " | 1,286 | 30.3 |
| 6 | This invention | " | " | 1,177 | 23.7 |
| 7 | This invention | " | " | 1,208 | 25.2 |
| 8 | This invention | " | " | 1,245 | 21.8 |
| 9 | This invention | " | " | 1,198 | 26.6 |
| 10 | This invention | " | " | 1,140 | 28.1 |
| 11 | This invention | " | " | 1,270 | 27.3 |
| 12 | This invention | " | " | 1,115 | 36.3 |
| 13 | This invention | " | " | 1,226 | 34.0 |
| 14 | This invention | " | " | 1,743 | 33.8 |
| 15 | This invention | " | " | 1,592 | 27.7 |
| 16 | This invention | " | " | 1,416 | 25.8 |
| 17 | This invention | " | " | 1,603 | 24.8 |
| 18 | Reference | " | " | 1,814 | 20.4 |
| 19 | " | " | " | 1,221 | 21.2 |
| 20 | " | " | " | 1,170 | 19.9 |
| 21 | " | " | " | 1,133 | 20.0 |
| 22 | " | " | " | 866 | 22.5 |
| 23 | " | " | " | 1,178 | 22.0 |

TABLE 2-continued

| No. | Division | Creep rupture test Temperature | Stress (kg/mm$^2$) | Rupture time (hr) | Rupture elongation (%) |
|---|---|---|---|---|---|
| 24 | " | " | " | 875 | 9.8 |
| 25 | " | " | " | 1,241 | 23.1 |

TABLE 3

| No. | Division | Bending angle (bending radius 19 mm) | Crack after bending test |
|---|---|---|---|
| 1 | This invention | 180° | Not found |
| 2 | " | " | " |
| 3 | " | " | " |
| 4 | " | " | " |
| 5 | " | " | " |
| 6 | " | " | " |
| 7 | " | " | " |
| 8 | " | " | " |
| 9 | " | " | " |
| 10 | " | " | " |
| 11 | " | " | " |
| 12 | " | " | " |
| 13 | " | " | " |
| 14 | " | " | " |
| 15 | " | " | " |
| 16 | " | " | " |
| 17 | " | " | " |
| 18 | Reference | " | Found |
| 19 | " | " | " |
| 20 | " | " | " |
| 21 | " | " | " |
| 22 | " | " | " |
| 23 | " | " | " |
| 24 | " | " | " |
| 25 | " | " | " |

TABLE 4

| No. | Division | Creep rupture strength | Toughness | Weldability |
|---|---|---|---|---|
| 1 | This invention | o | o | o |
| 2 | " | o | o | o |
| 3 | " | o | o | o |
| 4 | " | o | o | o |
| 5 | " | o | o | o |
| 6 | " | o | o | o |
| 7 | " | o | o | o |
| 8 | " | o | o | o |
| 9 | " | o | o | o |
| 10 | " | o | o | o |
| 11 | " | o | o | o |
| 12 | " | o | o | o |
| 13 | " | o | o | o |
| 14 | " | o | o | o |
| 15 | " | o | o | o |
| 16 | " | o | o | o |
| 17 | " | o | o | o |
| 18 | Reference | o | o | x |
| 19 | " | o | o | x |
| 20 | " | o | o | x |
| 21 | " | o | o | x |
| 22 | " | x | o | x |
| 23 | " | o | o | x |
| 24 | " | x | x | x |
| 25 | " | o | o | x |

Samples No. 1 to No. 25 were melted in a high frequency melting furnace having a melting capacity of 30 kg according to the composition shown in Table 1 (wherein the balance is Fe), and were cast by centrifugal casting to obtain tubes measuring 140 mm in outside diameter, 25 mm in thickness, and 340 mm in length. Then, necessary test pieces were cut out and presented for the test.

Table 2 records the results of the creep rupture test conducted in the method specified in JIS Z 2272. As the index to evaluate the high temperature toughness, the creep rupture elongation is indicated.

In order to assess the weldability, the guided bend test for welded butt joint was performed according to the method specified in JIS Z 3122. The results are shown in Table 3.

Table 4 summarizes the results of judgement of creep rupture strength, toughness and weldability. Alloys of which creep rupture time is not more than $10^3$ hours and elongation is not more than 15% are regarded to have failed to reach the intended level of the present invention, and, hence, are identified with an x-mark.

As evident from Table 2 and Table 3, the creep rupture strength was comprehensively excellent in samples No. 1 to No. 17 of iron-based heat-resistant cast alloys pertaining to the present invention, as compared with reference samples No. 18 to No. 25, and also in the guided bend test results, no crack was observed at all in the samples No. 1 to No. 17 of this invention while cracks were noted in all the reference samples No. 18 to No. 25.

Table 4 refers to the creep rupture strength, toughness, and weldability of samples No. 1 to No. 17 of iron-based heat-resistant cast alloys relating to this invention and of reference samples No. 18 to No. 25.

That is, No. 1, containing B, excels in creep rupture strength; No. 2 and No. 3, containing B and Ti, excel in creep rupture strength and weldability; No. 4 and No. 5, containing B, excel in creep rupture strength; No. 6 and No. 7, containing Ti, excel in weldability; No. 8 and No. 9, containing Ce+La, excel in weldability; No. 10 and No. 11, containing Ca, excel in weldability; No. 12 and No. 13, containing Zr, excel in weldability; No. 14, containing B, Ti, Ca, Ce+La and Zr, excels in creep rupture strength and weldability; No. 15, containing B and Ti, excels in creep rupture strength and weldability; No. 16, containing B, Ti and Ce+La, excels in creep rupture strength and weldability; and No. 17, containing B, Ti, Ce+La and Ca, excels in creep rupture strength and weldability.

By contrast, No. 18, having a higher content of B than the alloys of the present invention, excels in creep rupture strength but is inferior in weldability; No. 19, having a higher content of Ti than the alloys of the present invention, is inferior in weldability; No. 20, having a higher content of Ce+La than the alloys of the present invention, is inferior in weldability; No. 21, having a higher content of Ca than the alloys of the present invention, is inferior in weldability; No. 22, having a higher content of Zr than the alloys of the present invention, is inferior in creep rupture strength and weldability; No. 23, having a higher content of Mo and N than the alloys of the present invention, is inferior in weldability; No. 24, having a higher content of Mo and N than the alloys of the present invention, is inferior in toughness and weldability; and No. 25, of which contents of B, Ti, Ca, Ce+La and Zr are all below the ranges of the present invention, is inferior in weldability.

As understood from these embodiments, improvement of weldability in the region around 1% of the Nb content where the creep rupture strength is heightened but weldability is worsened has been successfully solved by the contents of trace elements, which are Ti, Ce, La, Ca and Zr, and a very slight content of B has enabled to improve the creep rupture strength in the entire range of Nb contents without deteriorating the weldability.

As explained above, since the iron-based heat-resistant cast alloy by this invention possesses aforementioned compositions, it excels in creep rupture strength, toughness and weldability, and hence it is an adequate material for heat resistant parts such as trays and pots used under cyclic environments of heating and cooling, and heat resistant parts such as reaction pipes and thick wall welded structures used under environments where exerts stress with thermal relaxation characteristics to absorb the thermal stress derived from temperature difference between the inside and outside of the pipe with the creep deformation of the pipe interior surface.

What is claimed is:

1. An iron based, heat resistant cast alloy consisting essentially of, by weight %:

0.10 to 0.16 carbon $1.0 \geqq Si > 0$, $1.5 \geqq Mn > 0$, 17 to 23 chromium, 28 to 35 nickel, 0.3 to 2.0 niobium, $0.1 \geqq Mo \geqq 0$, $0.08 \geqq N \geqq 0$, 0.001 to 0.010 calcium, and the balance iron.

2. An iron based, heat resistant cast alloy, consisting essentially of, by weight %:

0.10 to 0.16 carbon, $1.0 \geqq Si > 0$, $1.5 \geqq Mn > 0$, 17 to 23 chromium, 28 to 35 nickel, 0.3 to 2.0 niobium, $0.1 \geqq Mo \geqq 0$, $0.08 \geqq N \geqq 0$, 0.001 to 0.01 calcium, at least one element selected from the group consisting of 0.001 to 0.08 boron, 0.001 to 0.02 titanium, 0.001 to 0.01 cerium and/or lanthanum, and 0.01 to 0.1 zirconium and the balance iron.

3. A high temperature, high pressure pipe, consisting essentially of, by weight %:

0.01 to 0.16 carbon, $1.0 \geqq Si > 0$, $1.5 \geqq Mn > 0$, 17 to 23 chromium, 28 to 35 nickel, 0.3 to 2.0 niobium, $0.1 \geqq Mo > 0$, $0.08 \geqq N > 0$, 0.001 to 0.010 calcium, and the balance iron.

4. A high temperature, high pressure pipe, consisting essentially of, by weight %:

0.10 to 0.16 carbon, $1.0 \geqq Si > 0$, $1.5 \geqq Mn > 0$, 17 to 23 chromium, 28 to 35 nickel, 0.3 to 2.0 niobium, $0.1 \geqq Mn \geqq 0$, $0.08 \geqq N \geqq 0$, 0.001 to 0.010 calcium, at least one element selected from the group consisting of 0.001 to 0.08 boron, 0.001 to 0.02 titanium, 0.001 to 0.01 cerium and/or lanthanum and 0.01 to 0.10 zirconium, and the balance iron.

* * * * *